United States Patent [19]

Cho

[11] 4,061,220

[45] Dec. 6, 1977

[54] CORRECTING DEVICE FOR TYPEWRITERS

[76] Inventor: Chi-Liang Cho, Feldblumenweg 47, Zurich, Switzerland, 8048

[21] Appl. No.: 584,594

[22] Filed: Jan. 5, 1976

[51] Int. Cl.[2] ..... B41J 35/22; B41J 35/28

[52] U.S. Cl. ..... 197/181; 197/151

[58] Field of Search ..... 197/151, 172, 181

[56] References Cited

U.S. PATENT DOCUMENTS

| | | | |
|---|---|---|---|
| 756,808 | 4/1904 | Alexander | 197/162 |
| 1,415,293 | 5/1922 | Baldwin | 197/181 |
| 3,643,777 | 2/1972 | Anderson et al. | 197/151 |
| 3,643,779 | 2/1972 | Anderson et al. | 197/151 |
| 3,747,734 | 7/1973 | Norman et al. | 197/181 |
| 3,834,512 | 9/1974 | Haugen | 197/181 |
| 3,927,747 | 12/1975 | Wolowitz | 197/181 X |

*Primary Examiner*—Paul T. Sewell

*Attorney, Agent, or Firm*—Stuart J. Friedman

[57] ABSTRACT

A correcting device for a typewriter comprises a mount for fixedly mounting the device on the typewriter, a cover member slidably supported from said mount, a cassette containing rotatable feed and take-up spools for feeding and winding up, respectively, type correcting strip, said cassette removably supported from said cover member, said cover member and said supported cassette being moveable on said mount between operative (correcting) and inoperative (normal typing) positions. Ratchet teeth are provided on the take-up spool which cooperate with a lever actuated pawl whereby a segmental movement is imparted to the take-up spool upon depression of a key of the typewriter. A curved cam in cooperative association with the correcting strip roll periphery on the take-up spool are also provided to control movement of the lever so that segmental movement of the take-up spool is substantially uniform regardless of the diameter of the correcting strip roll wound onto the take-up spool. A control lever having a forked end for detachably engaging the ink ribbon lever of the typewriter controls lifting of the ink ribbon of the typewriter in such a manner that the ribbon is lifted during normal typing operation but is not lifted during correcting since the control lever is disengaged from the ink ribbon lever when the correcting device is in the operative (correcting) position.

12 Claims, 10 Drawing Figures

A

CORRECTING DEVICE FOR TYPEWRITERS

The present invention relates to an improved correcting device for use in a typewriter. It is known that typing mistakes can be corrected by means of type-correcting paper or strip which the typist places by hand over the typing sheet where it rests against the typewriter platen and then obliterates the wrongly typed character simply by re-keying it. This method of correction is very awkward since it is difficult to place the correcting strip in such a manner that the type does not strike a previously used spot of the strip, with the result that the wrongly typed character is only partly obliterated. Furthermore, once an unused spot of the strip has been positioned over the character to be corrected, it is difficult to keep the strip in position and also move it along. Thus, when a whole word or sentence is to be corrected, the strip is usually deflected or fouls the paper retainer of the typewriter. Moreover, trying to avoid used spots quickly and with certainty involves a great waste of correcting paper or strip.

Another possibility is that of arranging the correcting strip in a form similar to the ink ribbon and parallel thereto. This arrangement is only expedient in typewriters whose types are closely arranged in a small space, such as typewriters having spherical type heads, where there is sufficient room for the accomodation of another ribbon.

In ordinary typewriters having forty type bars there is too little space for a second controlled-feed ribbon arrangement. Also, it is difficult for the manufacturer to introduce modifications in the restricted space available in the existing constructions of typewriters of this kind as well as in the production equipment. Furthermore, the rather frequent and awkward changing of the correcting ribbon, which has to be discarded after first use, would be too inconvenient for the typist.

The object of the present invention is to overcome the aforesaid drawbacks by providing a correcting device which can be installed in an ordinary typewriter of the type bar kind without any complicated alteration in the construction of the latter and whereby changing of the correcting strip is facilitated.

Two embodiments of the invention are now described, as follows, reference being had to the accompanying drawings in which FIG. 1 is a perspective view showing a typewriter fitted with a correcting device of the present invention in operative position;

Figure 1:
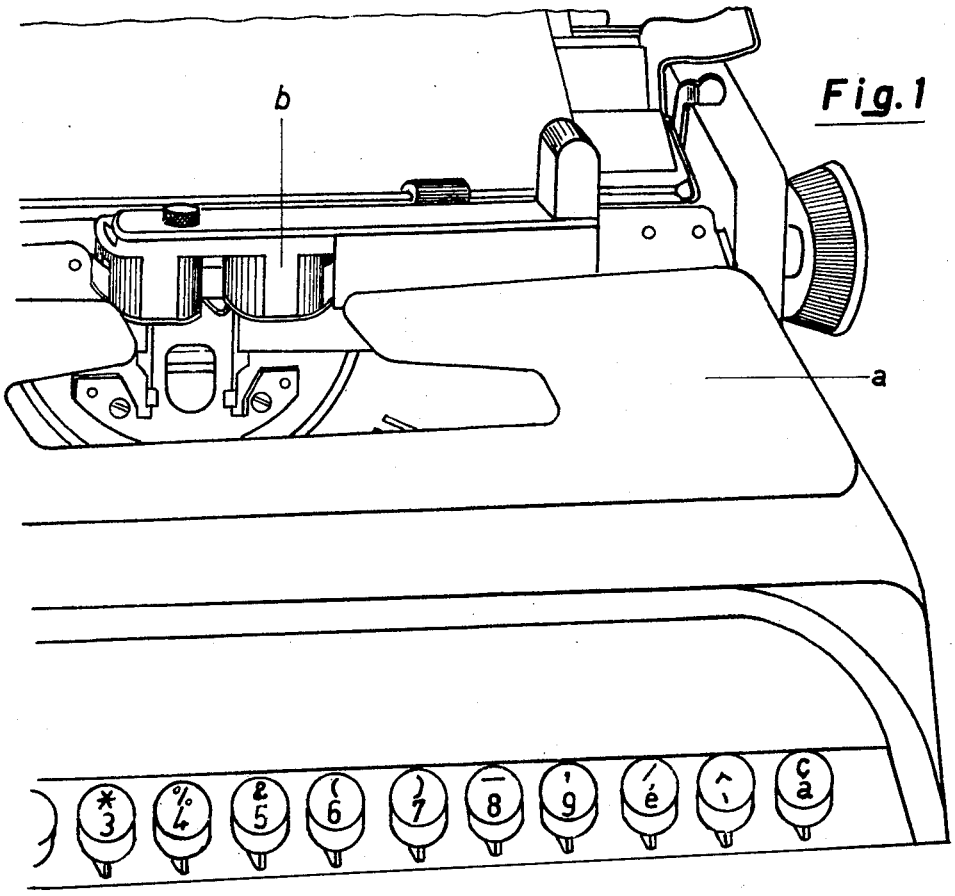
Figure 2:
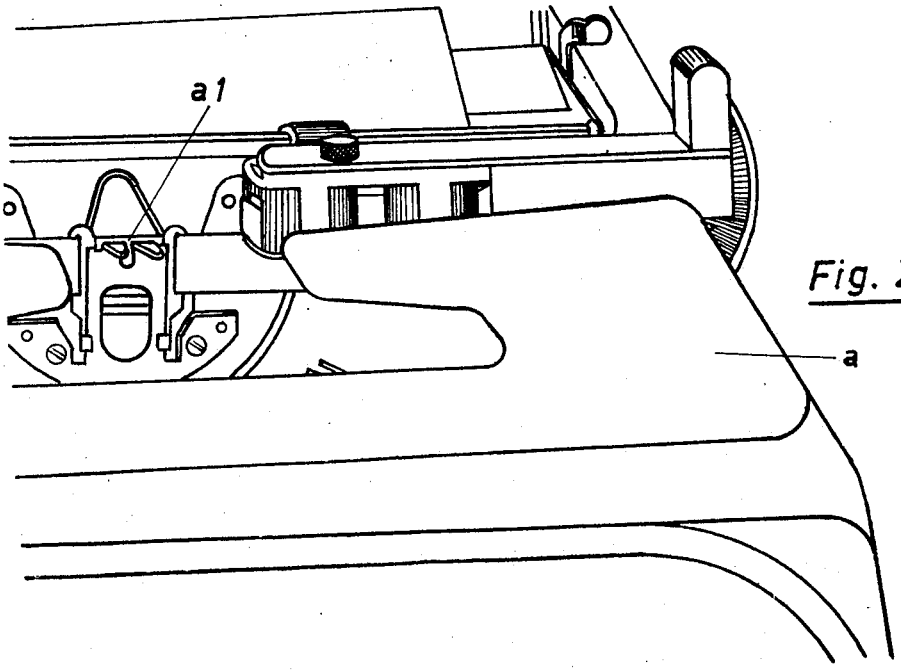
FIG. 2 is a view similar to FIG. 1 showing the correcting device in the inoperative position.
Figure 3:
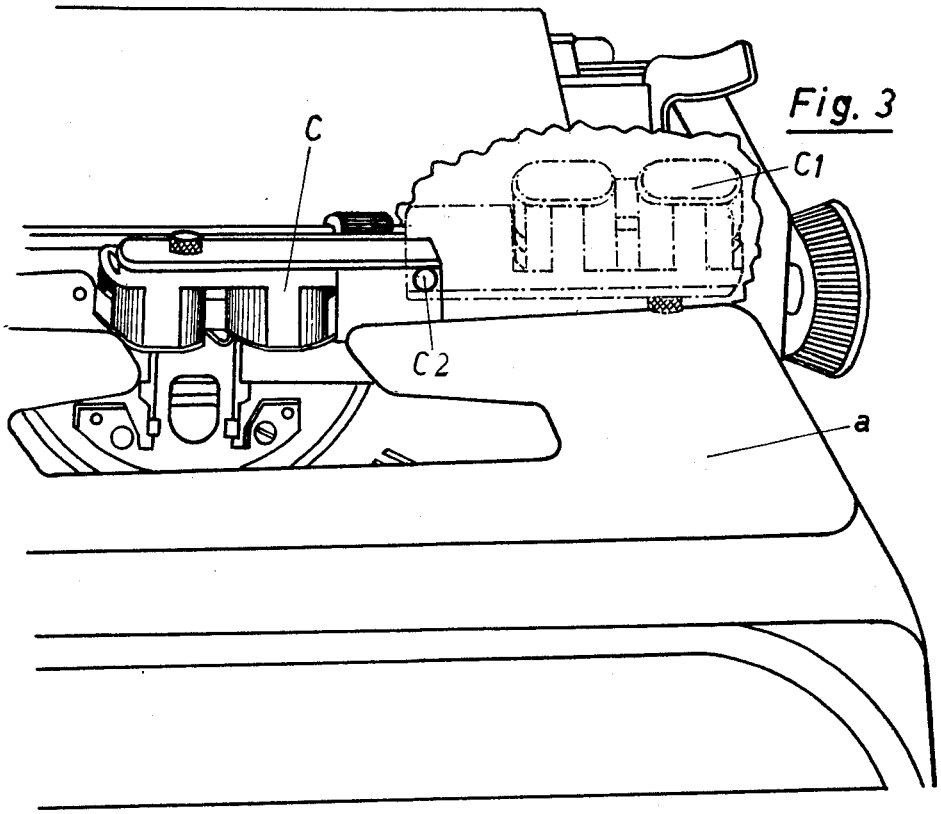
FIG. 3 is a perspective view of a typewriter showing a second embodiment of the correcting device illustrated in both the operative and inoperative positions.

The drawings show two embodiments of the correcting device, the first of which is shown in FIGS. 1 and 2 wherein the correcting device *b* is moved linearly and parallel to the typewriter platen between operative and inoperative positions. In the second embodiment shown in FIG. 3, the correcting device *c* is swung about a pivot *c*2 fixed to the typewriter, through approximately 180° in a plane parallel to the platen between operative and inoperative positions. The feed of the correcting strip when in the operative position is actuated by the application of keying pressure in conjunction with the corresponding mechanism of the typewriter. This feed function and the concurrent disengagement of the ink ribbon, as will more fully be described hereinafter are basically similar in both embodiments of the invention. Therefore, the description which follows deals in detail only with the first embodiment.

The correcting device *b* as shown in FIGS. 1, 2 and 5–10, comprises the feed mechanism and guide element 14 fixedly mountable in a typewriter and slidably carrying an upper cover or cover member 1 of the device, the cover receiving an expendable cassette 15 containing rotatable take-up and feed spools 17,18 respectively. The cassette 15 is made of plastic in a single piece and is divided into two spool chambers for receiving take-up spools 17 and feed spool 18. The feed spool 18 contains a roll of correcting strip 19 which stretches across gap 20 and is fed to the take-up spool 17. The spool chambers are closed at their underside by caps 16. The web spanning the upper part of cassette 15 and connecting the two spool chambers includes a longitudinally extending dovetail-shaped or wedge-shaped tongue 9 which is removably received adjacent the upper cover 1 of the device and retained by a screw 13, so that, once the correcting strip roll 19 is spent, the cassette 15 can be easily changed for a new one.

To remove the cassette 15, the screw 13 has to be slightly loosened so that the cassette can be removed from cover 1. When a new cassette is inserted, the screw 13 has to be tightened, so that the dovetail-shaped tongue is pressed firmly against the upper cover 1 of the device. The upper cover 1 of the device is provided with a bearing groove 10 which is slidable on the guide element 14 fixed to the typewriter, whereby cover 1 and the portion of correcting device *b* attached thereto can move parallel to and immediately in front of the platen.

Figures 6, 7, 8, 9, 10:
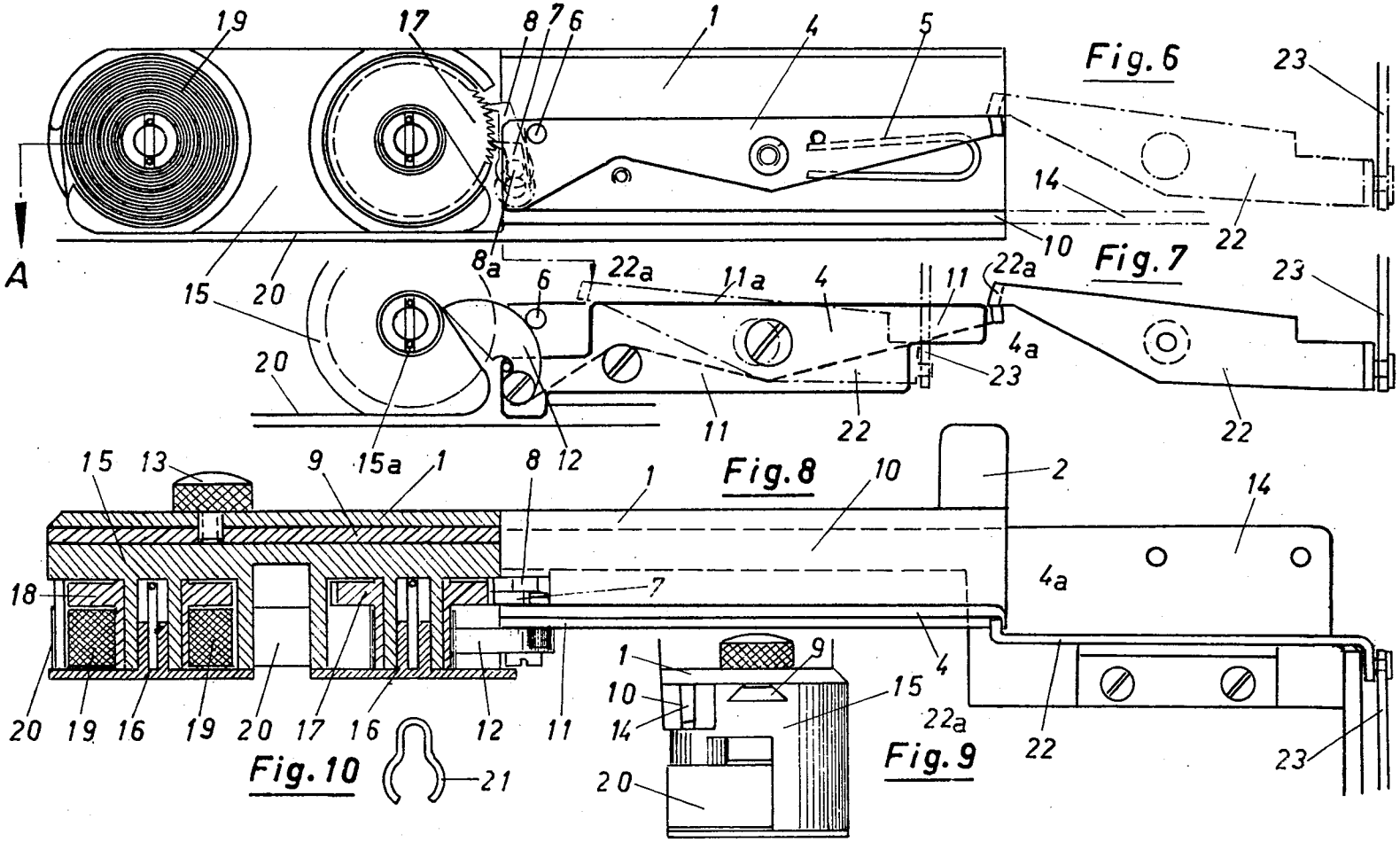
FIG. 6 is a bottom plan view, with portions removed, of the correcting device of FIG. 1.
FIG. 7 is a detail view showing the function of the cam lever mechanism for adjustment of the correcting strip feed.
FIG. 8 is a front elevational view, partly in section, of the correcting device of FIG. 1.
FIG. 9 is an end view of the correcting device shown in FIG. 8.
FIG. 10 is a detail view of a braking spring for the feed and take up spools of the correcting device of FIG. 1.

For making a correction, the cover 1 together with the combined cassette 15 is moved using fingerpiece 2 to the left (as shown in FIG. 8) towards the middle of the typewriter until the gap 20 between the two spool chambers of the cassette 15 is positioned exactly opposite the V-shaped type guide *a*1 in FIG. 2 by means of a stop. The typewriter carriage is moved to a position such that the character to be corrected is also moved to that mid-position. By re-keying the particular character, the typist can obliterate the wrongly typed character, and, in like manner, it is thus possible to obliterate whole words and sentences.

Figure 4:
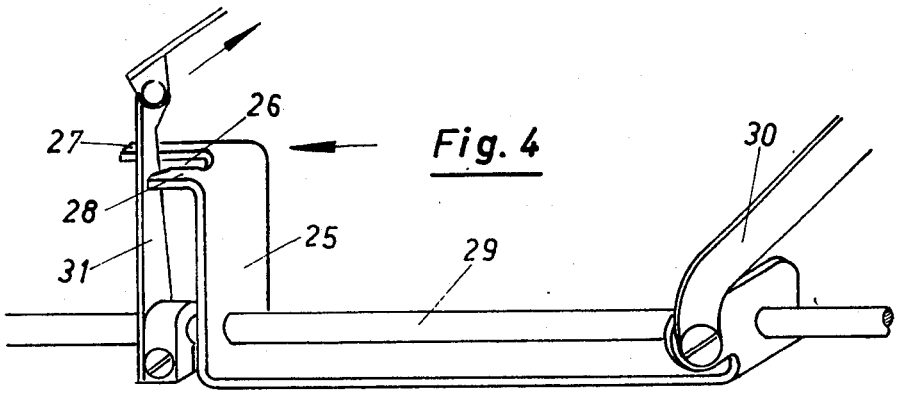
FIG. 4 is a perspective view showing the function of a control lever in disengaging the ink ribbon of a standard type bar typewriter.
Figure 5:
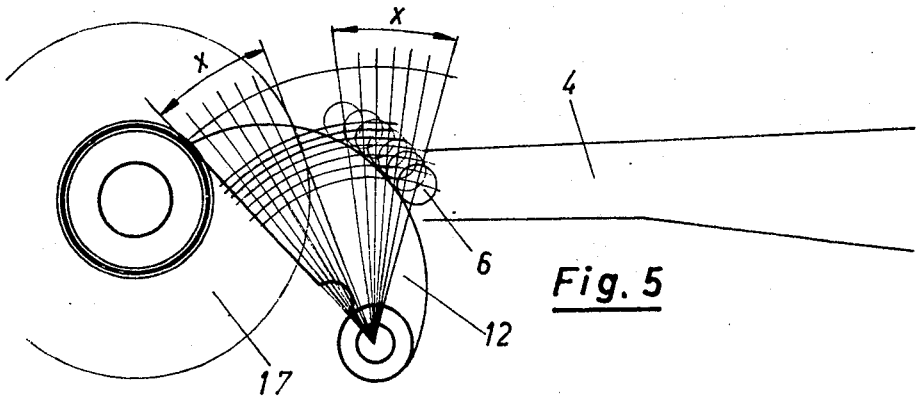
FIG. 5 is a detail view showing a cam lever mechanism for adjustment of the correcting strip feed.

Before correcting, however, the ink ribbon of the typewriter must be disengaged, and this is done by the means now to be described. A control lever 25 (FIG. 4) is pivoted jointly with the ink ribbon lever 31 on a shaft 29 of the typewriter. One end of the lever 25 is forkshaped, and one of the prongs 27 is longer than the other prong 28. The slot 26 between the two prongs engages the ink ribbon lever 31 in the normal working position. A link 30 is pivotally connected to the lever 25 and is action-connected to the universal bar (not shown) of the typewriter, which universal bar is well known in the art to actuate the ribbon feed and carriage movement of the typewriter on each key operation. Depressing any of the type keys, therefore, causes a pivoting movement of the lever 25, which also pivots the ink ribbon lever 31, so that the ink ribbon is lifted and the characters are typed. For correcting, however, the ink ribbon lever 31 must be disengaged from the slot 26 by a disengaging movement of the lever 25. This movement is effected by means of an intermediate lever (not shown), which, when the correcting device is moved towards the middle of the typewriter, causes the lever 25 to perform an opposed movement; i.e., in a direction away from the middle. After this opposed movement and when a character is keyed, the lever 25 performs a pivoting movement, but the ink ribbon lever 31 is no longer engaged, so that the ribbon is not lifted and correction alone is carried out. On completion of the correction, the correcting device is returned to the right (FIG. 2) and the lever 25 returns to the left, so that the ink ribbon lever 31 is again engaged by the slot 26.

After each single character correction, the used spot of the correcting strip is moved and this is effected in the following manner: The rim of the take-up spool 17 is provided with fine ratchet teeth which are engaged by two pawls 7 and 8. The pawl 7 is pivoted at the end of the lever 4 pivotally mounted on under cover plate 11 and engages the ratchet teeth under the action of spring 5 acting on lever 4. The pawl 8 is pivoted on a pin **8*a* fixed to the cover 1 and also engages the ratchet teeth under the action of a spring (not shown). An intermediate lever 22 pivoted on guide element 14 is action-connected by a link 23 to the universal bar of the typewriter. At each keying, link 23 causes the lever 4 to perform a pivoting movement, so that the lever 4 imparts, through the pawl 7, a segmental movement to the take-up spool 17, thereby causing the correcting strip to be intermittently advanced. The second pawl 8, which is not displaceable, prevents the spool 27 from back rotation when the pawl 7 returns. In this feed system, the feed stroke of the correcting strip varies between an empty and full take-up spool 17. Thus, for each equal segmental movement of the take-up spool 17, the feed of the strip is greater when the spool is full than when it is empty. To equalize the feed irrespective of the amount of strip on spool 17, a cam lever 12 is provided whose cam curve is evolved on the principle shown in FIG. 5 and which is operatively associated with the pin 6 on the lever 4 in such a manner that when the spool 17 is empty the cam lever 12 performs a larger pivoting movement and the lever 4 also performs a greater return movement as determined by the contact of pin 6 with the cam 12. With increasing diameter of the roll 19 on take-up spool 17, the cam lever 12 moves increasingly towards the pin 6**, so that its return path diminishes. In this manner, the feed of correcting strip is regulated to advance by the width of a character at each re-keying and thereby saves material.

To ensure continual and uniform tension of the correcting strip, a pronged spring 21 is provided which engages the slot of the bearings **15*a* of each spool of the cassette 15, the outwardly curved portion of spring 21** exerting a resilient pressure on the tubular wall of each of the spools.

FIG. 6 shows the device viewed from below, with the under cover plate 11 removed, and showing the position of the lever 4 and the intermediate lever 22, the latter indicated by the dash-dotted lines.

FIG. 7 shows the same arrangement, except with the cover plate 11 in position and having three functions, viz: (i) as cover guide and pivotal mounting for the lever 4; (ii) as bearing plate for the pivotal mounting of cam lever 12; (iii) as locking bar along edge **11*a* for locking the movement of the intermediate lever 22. Both the lever 4 and the intermediate lever 22 are provided at their engaging tips with bent lugs 4*a* and 22*a*, which engage each other, lug 4*a* being bent downwardly and lug 22*a* being bent upwardly, with the engaging point of the lugs in the same plane as the locking bar 11*a***. In the correcting position, i.e. in the operative position of device *b*, and in the normal typing position, i.e. in the inoperative position of device *b*, (as indicated by the dash-dotted line in FIG. 7), the bent lug of the intermediate lever 22 is located outside the locking bar **11*a*, so that it can be moved unhindered. The purpose of the arrangement is to accurately position the correcting device either to the normal typing position or to the correcting position. If the device is moved to any intermediate position between the correcting position and the typing position, the lug 22*a* will engage the locking bar 11*a* and thus prevent the movement of the intermediate lever 22**, causing all the action-connected type bars of the typewriter to also be blocked.

What is claimed is:

1. A correction device for use in combination with a type bar typewriter including a platen, type keys, type bars, an ink ribbon maintained in a normal rest position between the platen and said type bars and means including a universal bar and an ink ribbon lever for lifting said ink ribbon from its normal rest position to its normal typing position, when a type key is depressed, said correcting device comprising:

a. a cassette containing rotatable feed and take-up spools for receiving a roll type correcting strip, mounting means for fixedly mounting said device on said typewriter and means for removably mounting said cassette on said mounting means, said cassette being mounted on said mounting means with the correcting strip generally above the normal rest position of the ink ribbon and for lateral sliding movement in a direction parallel with the platen of the typewriter between operative and inoperative correcting positions, and correcting strip in said operative position disposed above said ink ribbon rest position and in the normal typing position of said ink ribbon; and b. means for preventing lifting of said ink ribbon to its typing position when a type key is depressed and said correction device is in said operative position.

2. A correcting device according to claim 1 wherein the cassette provides two side-by-side spool chambers, a first chamber containing a feed spool for supplying correcting strip from a roll of said strip and a second chamber containing a take-up spool for receiving correcting strip and for forming a roll of said strip.

3. A correcting device according to claim 1 wherein the cassette is a unitary piece of plastic.

4. A correcting device according to claim 2 wherein said means for removably mounting said cassette includes a cover member slidably mounted on said mounting means for movement in a direction parallel to the platen of the typewriter, said cassette being removably supported by said cover member.

5. A correcting device according to claim 4 including tongue means on said cassette and means engaging said tongue means and said cover member for supporting said cassette on said cover member.

6. A correcting device according to claim 5 wherein said cover member includes an aperture therein, said cassette includes a receptacle therein in registry with said aperture, and screw means passing through said aperture and received in said receptacle.

7. A correcting device according to claim 2 including means for controllably feeding correcting strip from the feed spool to the take-up spool of the cassette, said feeding means comprising ratchet teeth on the take-up spool, a pawl carried by a first lever, said pawl operatively associated with said ratchet teeth, a second lever operatively associated with said first lever, said second lever operatively connected to the universal bar of the typewriter, whereby upon depressing a key of the typewriter said second lever is moved by said universal bar, said first lever is operated by said second lever and said pawl is caused to impart a segmental movement to the take-up stool through said ratchet teeth for obtaining a step-wise advancement of the correcting strip.

8. A correcting device according to claim 2 wherein each spool in the cassette includes a bearing support therefore and spring means received in each bearing support biased to bear against each spool to provide frictional resistance against rotation of the spools.

9. A correcting device according to claim 7, including a locking member arranged to engage said second lever and to prevent movement thereof when said device is in a position other than the fully operative or inoperative positions of use.

10. A correcting device according to claim 7, including a pivotally mounted third lever having a curved cam profile, said third lever arranged to bear on the roll of correcting strip on said take-up spool so that as the diameter of the roll on said spool increases said third lever pivotally moves in a direction away from said roll, said third lever operatively associated with said first lever whereby pivotal movement of the third lever limits movement of said first lever and said pawl thereon to reduce segmental movement of the take-up spool by said pawl whereby feed movement of the correcting strip between the feed and take-up spools is substantially uniform regardlessof the amount of correcting strip wound on the take-up spool.

11. A correcting device as claimed in claim 4, wherein said preventing means comprises a control lever having a forked end detachably engaging the ink ribbon lever and operatively associated with the universal bar of the typewriter whereby said control lever engages said ink ribbon lever during normal typing operation to operate said ink ribbon lever when a type key is depressed to bring the ink ribbon into normal typing position and means operatively associated with said slidable cover member for disengaging said control lever from said ink ribbon lever when said device is moved into operative correcting position.

12. A correcting device according to claim 11 wherein the forked end of the control lever includes two prongs, one of said prongs being longer than the other of said prongs, said prongs defining a space therebetween for engaging the ink ribbon lever of the typewriter.

* * * * *